United States Patent [19]

Nussbaum et al.

[11] Patent Number: 4,503,776

[45] Date of Patent: Mar. 12, 1985

[54] FRAGMENTATION BODY FOR FRAGMENTATION PROJECTILES AND WARHEADS

[75] Inventors: Helmut Nussbaum, Bauler; Adolf Weber, Neukirchen, both of Fed. Rep. of Germany

[73] Assignee: Diehl GmbH & Co., Nuremberg, Fed. Rep. of Germany

[21] Appl. No.: 334,834

[22] Filed: Nov. 30, 1981

[30] Foreign Application Priority Data

Dec. 2, 1980 [DE] Fed. Rep. of Germany ..... 3045361

[51] Int. Cl.[3] ..... F42B 13/18

[52] U.S. Cl. ..... 102/496; 102/506

[58] Field of Search ..... 29/1.2–1.23; 164/108, 112, 333; 249/122, 85; 264/277; 102/489, 506, 491, 494–497, 501, 364; 86/20 B; 244/3.23, 3.24

[56] References Cited

U.S. PATENT DOCUMENTS

| | | | |
|---|---|---|---|
| 55,796 | 6/1866 | Haycock | 102/501 |
| 1,154,437 | 9/1915 | Rimailho | 102/496 |
| 1,240,217 | 9/1917 | Ingram | 102/497 |
| 1,259,224 | 3/1918 | Guibert | 164/112 X |
| 1,288,883 | 12/1918 | Harvey | 244/3.23 |
| 1,333,593 | 3/1920 | MacDermott | 164/108 |
| 2,568,126 | 9/1951 | Keeley | 264/277 |
| 3,489,088 | 1/1970 | Von Ballmoos et al. | 102/496 |
| 4,008,747 | 2/1977 | Devers et al. | 164/112 |
| 4,129,061 | 12/1978 | Bedall | 29/1.23 X |
| 4,333,401 | 6/1982 | Byers et al. | 102/487 |

FOREIGN PATENT DOCUMENTS 2536308 2/1977 Fed. Rep. of Germany .

*Primary Examiner*—Harold J. Tudor

*Attorney, Agent, or Firm*—Scully, Scott, Murphy & Presser

[57] ABSTRACT

Known projectiles with molded fragments are usually produced in the shape of steels or rollers produced with the aid of powder technology or in a flow compression process. The molded fragments are located in a dense packing in the wall of fragmentation bodies without being able to be brought into an orientation which is advantageous for the fragmentation effect. In order to enhance the fragmentation effect, the fragments are arranged with regard to their orientation and mutual spacing within a casting form in a pattern provided in an inner mold form, and subsequently provided with the cast material. Required through the form-fitting support of the fragments through protuberances projecting into the fragments, after the removal of the fragmentation body the recesses formed in the fragments can have incendiary charges pressed therein. Thereby the fragmentation is enhanced by the additional incendiary effect.

9 Claims, 5 Drawing Figures

FRAGMENTATION BODY FOR FRAGMENTATION PROJECTILES AND WARHEADS

BACKGROUND OF THE INVENTION

1. Field of the Invention

The invention relates to a fragmentation body for fragmentation projectiles and warheads in which prefabricated fragments are molded into a tubular fragmentation shell constituted of metal, or other suitable castable materials.

2. Discussion of the Prior Art

Known from German Patent Specification No. 25 36 308 is a fragmentation body for fragmentation projectiles and warheads in which spherical fragments are retained within a grid-shaped hollow cylinder for the purpose of being cast about by metal. The requirement for the production of a fragmentation body of that type is expensive due to the grid structure, and during the destruction of the fragmentation body influences the energy transfer from the explosive to the spherical fragments.

SUMMARY OF THE INVENTION

The present invention has as its object the provision of a fragmentation body of large penetrative effect. Due to the projectile-like shape of the fragments there is provided a high penetrating power. The recess in the base of the fragments facilitates that the fragments evidence the contemplated position, orientation and desired spacing relative to the adjacent fragments. Hereby, the protuberances which orient the fragments can be provided on the inner mold form as well as the outer mold form.

The mutual spacing of the fragments is to be determined empirically. Utilized as parameters are the employed cast material for casting about the fragments with respect to its casting-technological form filling capability and, when required, the application of the cast material as additional fragmentation material to the prefabricated fragments.

Besides the increased penetrating power of the fragmentation bodies, their effect can be enhanced through the impressing of known per se incendiary charges into the recesses in the fragments. Through suitable selection of the incendiary charges there can be achieved that a conflagration effect will be added to the penetrating effect, through which, for example, there are ignited flammable liquids which will flow out from destroyed conduits and containers. In addition thereto, the recesses can be filled with incendiary compounds, explosives, detonators, luminescent compound or fogging material.

Pursuant to a specific feature of the invention, the fragments include flight trajectory-stabilizing fins. Achieved thereby is that the fragements are aerodynamically stabilized along their flight trajectory. During casting, in the course of the production there are formed in the projectile wall images of the fins in the cast material, in essence, rupture notches, so that high tensile stresses will be produced in the notch bottoms during cooling. As a rule, the thermal coefficient of expansion of the shaped fragments is substantially lower than that of the cast material. Consequently, the cast material is prestressed within the notch so that the commencement of a rupture in the projectile wall is of especially high influence on the fragmentation formation, in particular, the fragment configuration of the cast material. In addition thereto, the predetermined notching of the cast material is significant for the initiation of the rupture and the extent of the rupture in the cast material, and is thus decisive for the positioning of the flying-off, prefabricated fragments.

In accordance with the configuration pursuant to FIG. 4, there is enhanced the flight trajectory-stabilizing effect of the fragments and, moreover, the cast body is notched throughout from exteriorly towards the interior so that there is achieved a definite fragment configuration for the cast material.

Pursuant to a speicific aspect of the invention, the fins of the fragments can be so oriented that the fins of adjoining fragments will be located opposite each other; in essence, the thickness of the cast material is extremely thin and therefore, for releasing the fragments from the cast material, there is required a relatively small destructive force. Through suitable positioning of the fins within the cast material, in dependence upon the shapes of the recesses and protuberances it is possible to provide for suitably numerous variations.

According to another features, required for the forms is a ceramic compound only for high temperature melting materials. For other cast materials, such as aluminum or brass, there are employed known steel molds which afford the advantage of a broad applicability. For the fragmentation body there can also be taken into consideration weaker embedding materials when this is permitted by the loading of the projectile, as for example, zinc and plastic materials (fiber-reinforced, lightened with filler materials), by means of which such a form can be also filled through the so-called injection molding process.

BRIEF DESCRIPTION OF THE DRAWINGS

Exemplary embodiments of the invention are illustrated in the drawings. Shown is.

DETAILED DESCRIPTION

Figure 1:
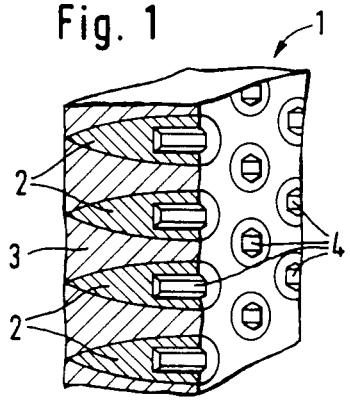
FIG. 1 illustrates a sectional view of a fragmentation body.

Pursuant to FIG. 1, the fragmentation body 1 includes fragments 2 and interposed cast material, in essence, cast iron 3. The fragments 2 are provided with a hexagonal recess 4 in their bases.

Figure 2:
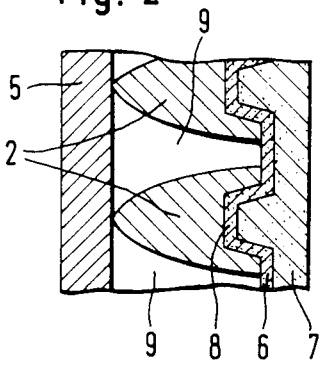
FIG. 2 illustrates an inner and outer form with fragments.

According to FIG. 2, the fragments 2 are retained between an outer mold form 5 of steel and an inner form 6 with a support 7. The inner mold form 6 consists of ceramic and evidences protuberances 8 in conformance with the hexagonal recesses 4. The inner form 6 is sintered onto the support 7, which is also constituted of ceramic. The prefabricated fragments 2 are mounted on the protuberances which are arranged in a pattern. The fragments 2 consist of sintered iron. The fragmentation body 1 is now produced in that cast iron is filled into the interspaces 9. After the solidifying of the cast iron, the inner mold form 6,7 is broken apart and the fragmentation body 1 is removed from the outer mold form 5.

Besides the inner mold form 6 which is constituted of ceramic, as well as the support 7, there can also be utilized a multicomponent inner mold form 6 which is constituted of metal, such as aluminum. For removing the fragmentation body from the mold form, the individual mold form segments, which must be correlated with respect to each other, are removed from the fragmentation body 1. Besides the cast iron there can be also considered other filler compounds, such as aluminum, zinc and plastic materials.

Figure 3:
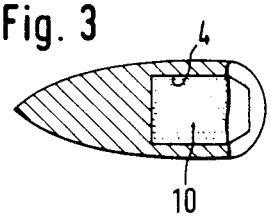
FIG. 3 is a fragment with incendiary compound.

Pursuant to FIG. 3, a known incendiary charge 10 formed of thermite is pressed into the recess 4, which will spontaneously ignite upon impact.

Figure 4:
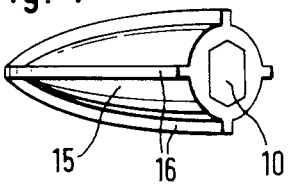
FIG. 4 is a fragment with fins.

Pursuant to FIG. 4, a fragment 15 is provided with fins 16 extending along its entire length 4. These fins cross each other at the tip of the fragment 15. This fragment 15 is produced in a sintering process (powder pressing technology).

Figure 5:
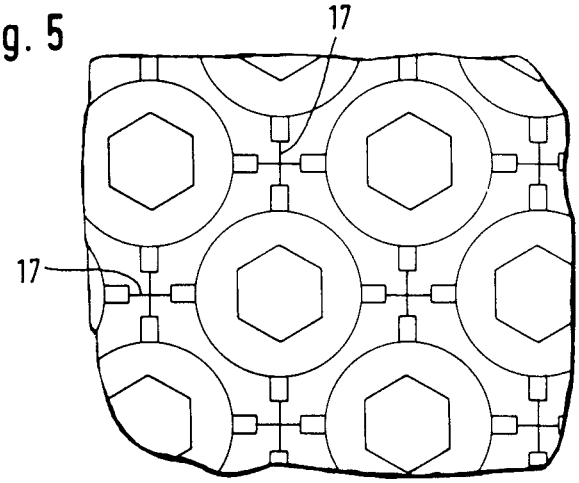
FIG. 5 is a plan view of a portion of a fragmentation body.

According to FIG. 5, the fragments 15 are so arranged within the cast material that the fins 16 of adjacent fragments 15 form preferable rupturing zones 17 in the cast material. Upon the detonation of the explosive, not shown in FIG. 5, the cast material is preferably fractured along the fracture lines 17 and accelerated separate from the fragments. The fragments 15 are aerodynamically stabilized during the flight by the fins 16. Upon the impact against and penetration of the target, the fragments 15 will explode so as to ignite the incendiary charges 10. Due to the flammable medium which has been caused to flow out by the fragments 15, this will be ignited by the incendiary charges 10.

In addition to the fragment arrangement pursuant to FIG. 1, it is also possible to have a fragment arrangement in which the tips of the fragments are radially inwardly directed, and the fragments are provided with fins as in FIG. 4.

Achieved hereby is that the incendiary charges are not ignited already upon the detonation of the explosive, but actually first upon impact of the fragments 2 against the target. Notwithstanding the reversed arrangement of the fragments, there is achieved the same acceleration of the fragments through the explosives, since the cast material acts as a propelling surface which will then detach from the fragments. The aerodynamic stabilization of these fragments is then achieved by means of the fins and through the center of gravity which is located in the region of the fragment tips (arrows stabilization). An ignition of the incendiary charge by means of the explosive can also be avoided when a thin-walled steel sleeve is arranged between the fragmentation body and the explosive.

We claim:

1. Fragmentation body for fragmentation projectiles and warheads, including a plurality of prefabricated fragments molded into a tubular fragmentation shell constituted of cast material; the improvement comprising: each of said fragments having a projectile-like configuration including a pointed tip and a base portion, and a recess being formed in the base portion, flight trajectory-stabilizing fins being formed on each of said fragments and providing highly-stressed rupturing zones in the cast material of the fragmentation shell, whereby upon impact against a target said fragments rupturing along said rupturing zones to facilitate maximized penetrating and fragmentation effects upon impacting against the target.

2. Fragmentation body as claimed in claim 1, wherein incendiary charges are pressed into the recesses of each of said fragments to provide a configuration effect in a target.

3. Fragmentation body as claimed in claim 1, wherein said fins are spaced about the circumference of each of said fragments, said fins extending along the entire length of the fragments and crossing at the tips of the fragments.

4. Fragmentation body as claimed in claim 1, wherein the recesses in each of said fragments have a hexagonal cross-sectional profile.

5. Fragmentation body as claimed in claim 1, wherein the fins of adjacent positioned extend into close proximity with each other within said fragmentation shell so as to form readily rupturable zones in said shell upon detonation of the projectile or warhead.

6. Fragmentation body as claimed in claim 1, wherein the tips of each of said fragments are directed radially outwardly in said fragmentation shell.

7. Fragmentation body as claimed in claim 1, wherein the tips of each of said fragments are directed radially inwardly in said fragmentation shell.

8. Fragmentation body as claimed in claim 1, wherein said fragmentation shell is constituted of cast iron.

9. Fragmentation body as claimed in claim 1, wherein said fragments are constituted of sintered iron.

* * * * *